US006845728B1

(12) United States Patent
Horton

(10) Patent No.: US 6,845,728 B1
(45) Date of Patent: Jan. 25, 2005

(54) TOWABLE SUBMARINE MAST SIMULATOR

(75) Inventor: Duane M. Horton, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/679,678

(22) Filed: Oct. 6, 2003

(51) Int. Cl.[7] ..... B63G 8/42; B63G 9/00

(52) U.S. Cl. ..... 114/244; 114/253; 114/330; 114/340

(58) Field of Search ..... 114/312, 326–332, 114/322, 340, 242, 244, 245, 253, 254; 441/7, 10, 11, 20, 21, 23; 367/1, 87, 106, 130, 141; 273/350, 359

(56) References Cited

U.S. PATENT DOCUMENTS

| | | | | | |
|---|---|---|---|---|---|
| 1,557,049 | A | * | 10/1925 | Hammond, Jr. | 343/709 |
| 2,404,908 | A | * | 7/1946 | Hopkins | 114/21.2 |
| 2,413,350 | A | * | 12/1946 | Helmore | 114/21.1 |
| 2,979,089 | A | * | 4/1961 | Piesker | 81/57.11 |
| 3,106,712 | A | * | 10/1963 | Daggett | 343/709 |
| 3,106,721 | A | * | 10/1963 | Steer et al. | 2/209.11 |
| 3,131,391 | A | * | 4/1964 | Boswell et al. | 342/5 |
| 3,161,168 | A | * | 12/1964 | Rebikoff | 114/21.1 |
| 3,180,295 | A | * | 4/1965 | Niederer | 114/20.1 |
| 3,509,848 | A | * | 5/1970 | Salmon | 114/245 |
| 3,722,452 | A | * | 3/1973 | Wynn, Jr. | 114/244 |
| 3,900,703 | A | | 8/1975 | Tickle | |
| 3,972,046 | A | * | 7/1976 | Lombardi | 343/709 |
| 3,972,047 | A | * | 7/1976 | Lombardi | 343/709 |
| 4,189,148 | A | * | 2/1980 | Kato | 273/350 |
| 4,215,862 | A | * | 8/1980 | Yoshikawa et al. | 273/350 |
| 4,227,479 | A | * | 10/1980 | Gertler et al. | 114/312 |
| 5,144,587 | A | | 9/1992 | Mason | |
| 5,247,894 | A | | 9/1993 | Haisfield et al. | |
| 5,490,473 | A | | 2/1996 | Chace et al. | |
| 5,677,506 | A | * | 10/1997 | Wallin | 89/38 |
| 6,002,648 | A | * | 12/1999 | Ambs | 367/159 |
| 6,185,156 | B1 | | 2/2001 | Bouyoucos | |
| 2003/0000448 | A1 | * | 1/2003 | Kruger et al. | 114/340 |

FOREIGN PATENT DOCUMENTS

| | | | | |
|---|---|---|---|---|
| DE | 4114051 C1 | * | 9/1996 | B63G/8/34 |

* cited by examiner

*Primary Examiner*—S. Joseph Morano
*Assistant Examiner*—Ajay Vasudeva
(74) *Attorney, Agent, or Firm*—James M. Kasischke; Michael P. Stanley; Jean-Paul Nasser

(57) ABSTRACT

A submarine mast simulator as part of a buoyant tow body having a hydrodynamically shaped shell. The mast simulator includes a rigid lower mast section and an inflatable upper mast section extendable from the tow body. A plurality of stabilizer fins extend radially from the tail of the tow body, the fins being actuated to cause the ascent and descent of the tow body. A pressure sensor is positioned on an outer surface of the tow body for detecting a depth of the tow body, and a motor with controller is housed within the tow body, the controller initiating extension of the mast simulator in response to a depth indication.

11 Claims, 2 Drawing Sheets

TOWABLE SUBMARINE MAST SIMULATOR

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to the art of antisubmarine warfare training and is a device for simulating a submarine mast positioned above a water surface.

(2) Description of the Prior Art

A submarine mast (e.g., periscope or snorkel) extending above the water surface can be detected by several methods. In a first example of detection, metallic components of the submarine mast will display a radar footprint. In a second example of detection, the submarine's forward speed will cause the mast to generate a visible wake which is generally much easier to see than the mast itself. In a third example of detection, the thermal plume associated with diesel exhaust from a snorkel can be seen using infrared cameras. Lastly, a sniffer-type chemical sensor can discern various compounds contained within the diesel exhaust. All of these techniques for detection are presently used by aircraft and surface ships to conduct antisubmarine warfare (ASW) operations.

The use of naval service or real submarines to train ASW crews is problematic, limited by high expense and risk as well as the low priority of such training relative to a submarine's other missions. As such, low-cost, low-risk methods of training personnel to detect submarines are needed.

One method of detection assistance is to tow a catamaran behind an unmanned underwater vehicle (UUV). The catamaran would have a radar reflector and/or a heat source to mimic submarine characteristics. The catamaran approach lacks realism in that it does not permit the simulator to pop out of the water unannounced and disappear minutes later, as a real submarine mast would behave. Also, a catamaran's wake and visual appearance are quite different from those of a submarine mast. Finally, the catamaran must be released by the UUV and recovered separately in order for the UUV to perform other tasks during its run.

Another method of detection assistance is to deploy a periscope-like mast from a UUV traveling just below the surface. One working prototype extends 26.5 feet in length and weighs 3600 pounds. Bow planes increase the width of the UUV to 67 inches. Furthermore, the capability of the prototype is limited to periscope simulation. However, like all large UUVs, the prototype is expensive to build and operate. It requires a specially trained support crew, a complete logistics system and extensive maintenance, and its size makes the prototype cumbersome to launch, recover and transport. As a result, there is needed a low-cost mast simulator that can be towed and which resembles and operates like the mast of a real submarine.

The following references disclose ASW training devices, but do not disclose a mast simulator with the following characteristics: a visual appearance close to that of a submarine periscope or snorkel protruding above the water surface; a radar footprint equal to that of a submarine periscope or snorkel protruding above the water surface; a wake approximating that generated by a submarine periscope or snorkel protruding above the water surface; an infrared signature similar to that of a snorkeling diesel-electric submarine; chemical vapor emissions similar to those of a snorkeling diesel-electric submarine; programmable, submarine-like speed and maneuvering characteristics; an ability to surface/deploy and retract/submerge the mast simulator multiple times during a single run; the minimum drag exerted by the mast simulator when it is not surfaced/deployed; mast simulator hardware which can be jettisoned by the UUV when no longer needed during a mission; low production and maintenance costs; and relatively easy to handle, launch and recover.

Mason (U.S. Pat. No. 5,144,587) discloses an expendable moving echo radiator suitable for providing a decoy to attract a homing torpedo and divert the torpedo away from its intended target. The reference further discloses an expandable and collapsible curtain for deployment from a capsule launched from a submarine or other sea vessel. In its expanded configuration, the curtain is characterized by a physical profile sufficient to reflect acoustic waves aid to generate echoes substantially similar to echo signals generated by an actual, full-size submarine or other target. The cited reference further discloses propulsion means, as well as means for capturing a torpedo's sensors. As such, the expendable device can be used to simulate a submarine for ASW training. In using the echo radiator as a target, the expendable device can be preprogrammed or remotely controlled for self-navigation purposes.

Haisfield et al. (U.S. Pat. No. 5,247,894) discloses a decoy which simulates the evasive tactics of a submarine under attack for pulse echo-type search systems and which can be ejected through the flare tube of a submarine.

Chace, Jr. et al. (U.S. Pat. No. 5,490,473) discloses an expendable underwater vehicle for use in training naval forces in ASW which is between three and five feet in length and about five inches in diameter. The cited reference further discloses an in-water variable speed feature, a variable tonal levels feature, an autonomous evasion feature, and a high-power integrated pinger feature.

It should be understood that the present invention would in fact enhance the functionality of the above references by providing a submarine mast simulator having all of the visual, radar, thermal, chemical and wake generation characteristics of a real submarine mast yet is reusable and reliable.

SUMMARY OF THE INVENTION

Accordingly, it is a general purpose and primary object of the present invention to provide a submarine mast simulator for ASW training.

It is a further object of the present invention to provide a submarine mast simulator which simulates the visual appearance, radar footprint, infrared/chemical emissions, and wake generation characteristics of a submarine mast protruding above a water surface.

It is a still further object of the present invention to provide a submarine mast simulator which is easy to launch and recover.

It is a still further object of the present invention to provide a mast simulator which is towable by a UUV.

It is a still further object of the present invention to provide a mast simulator which is inexpensive to manufacture.

To attain the objects described, there is provided a tow body having a hydrodynamically shaped shell with a nose and a tail. A mast simulator extendable from the tow body includes a rigid lower mast section and an inflatable upper mast section. A plurality of stabilizer fins extend radially from the tail of the tow body. A pressure sensor is positioned on an outer surface of the tow body for detecting the depth of the tow body. A motor with controller is housed within the tow body; the controller initiates extension of the mast in response to a depth indication by the pressure sensor.

BRIEF DESCRIPTION OF THE DRAWINGS

A more complete understanding of the various objects, advantages and novel features of the present invention will be more apparent from a reading of the following detailed description in conjunction with the accompanying drawings wherein.

DESCRIPTION OF THE PREFERRED EMBODIMENT

Figure 5:
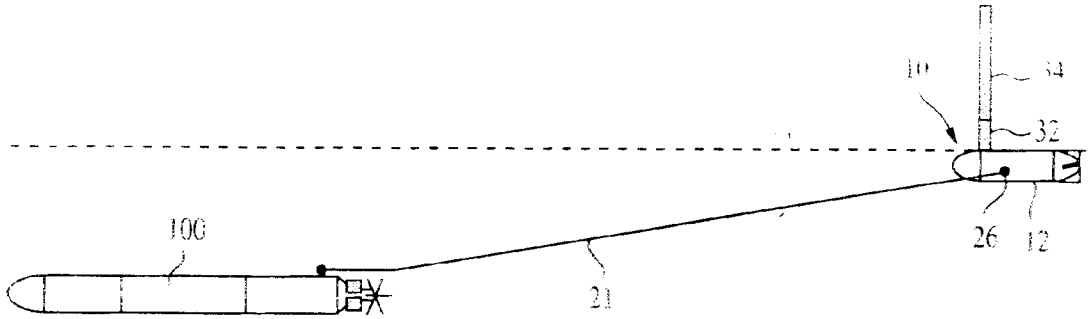
FIG. 5 is a side view of a fully deployed mast simulator of the present invention being towed.
Figure 6:
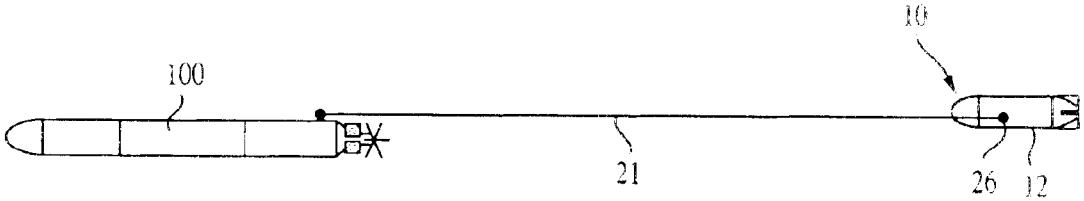
FIG. 6 is a side view of a retracted mast simulator of the present invention being towed at a cruising depth.

In general, the present invention is directed to a tow body 10 housing the structure of a mast simulator towed by an unmanned underwater vehicle (UUV) 100 (with FIGS. 5 and 6 depicting the towing operation and the UUV).

Figure 1:
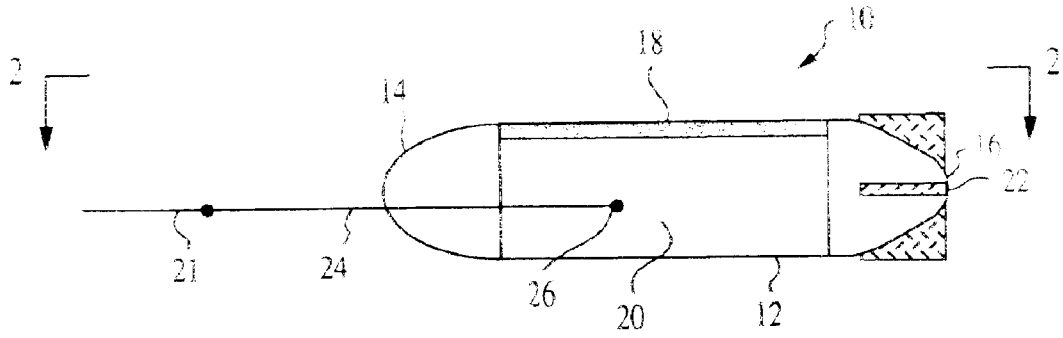
FIG. 1 is a side view of a tow body of the mast simulator of the present invention.

Referring now to the drawings wherein like numerals refer to like elements throughout the several views, one sees that FIG. 1 depicts the tow body 10 generally including a faired shell 12 having a nose 14 and a tail 16 with the tow body 10 being hydrodynamically shaped in order to minimize drag while being towed underwater.

A mast recess 18 is formed in the tow body 10 and extends along and into the faired shell 12 so that components retracted in the recess present a streamlined outer surface consistent with that of the faired shell 12.

A center of buoyancy for the tow body 10 is indicated as marking 20, with the center of buoyancy preferably below the longitudinal centerline of the tow body 10. The low center of buoyancy of the tow body 10 reduces the tendency of the tow body to roll, both submerged and at the surface. Having the tow body 10 close to neutrally buoyant allows it to follow directly behind the tow vehicle, thereby minimizing drag forces acting upon the tow cable 21.

A plurality of control or stabilizer fins 22 extend radially from the tail 16. The stabilizer fins 22 are sized and positioned to obtain a desired stability in roll, pitch and yaw, as well as to provide upward lift sufficient to surface the tow body 10 upon command.

Figure 2:
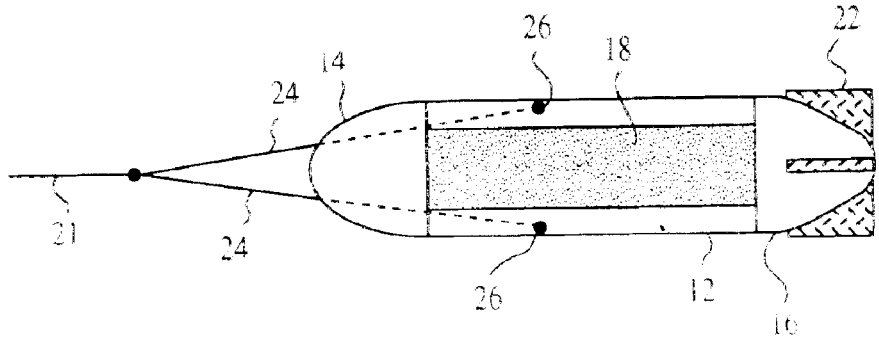
FIG. 2 is a top view of the tow body of the mast simulator of the present invention with the view taken from reference line 2—2 of FIG. 1.

As shown in FIG. 2, the tow body 10 includes a tow harness 24 attached to opposing sides of the faired shell 12 at attachment points 26 with the attachment points equidistant from the nose 14. The location of the attachment points 26 further improves the stability of the tow body 10 and reduces the likelihood of rolling. The exact location of the attachment points 26 is determined by the need to maximize the angle of attack of the tow body 10 during a surfacing maneuver while minimizing the instability of the tow body. As the attachment points 26 are moved rearward toward the midpoint of the tow body 10, the angle of attack of the tow body while surfacing increases. However, this rearward attachment causes a tendency for hydrodynamically unstable flight of the tow body 10.

Figure 3:
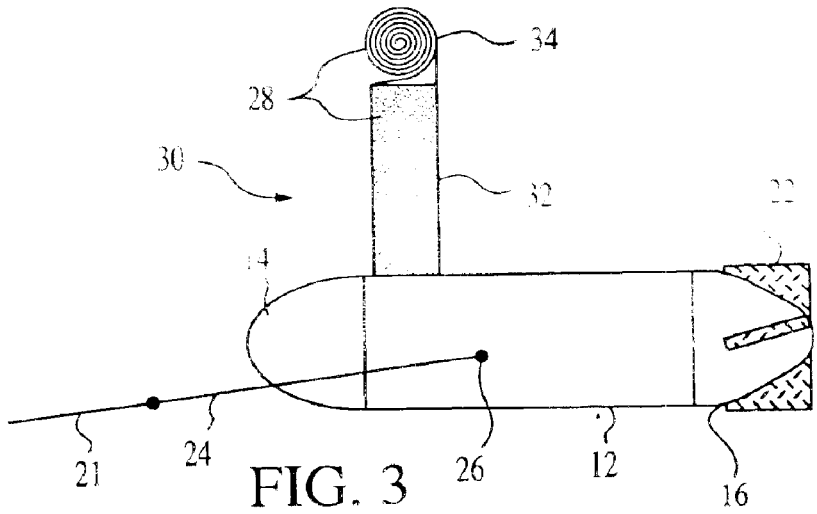
FIG. 3 is a side view of the mast simulator of the present invention in a semideployed position.

Referring now to FIG. 3, the mast simulator 30, carried by the tow body 10, is an extending two-part assembly including a rigid lower mast section 32 and an inflatable upper mast section 34. The lower mast section 32 is hollow with a radial cross-section similar to that of a submarine periscope or snorkel. The upper mast section 34, coiled and flat when not inflated, is attached to a tip or distal end of the lower mast section 32. The mast simulator's physical features provide a realistic simulation of a submarine periscope or snorkel in three respects: visual appearance, radar footprint, and wake generation. However, it is also important to limit the length of the stowed mast simulator 30 in order to minimize tow body length and associated drag, weight, and cost. The lower and shorter mast section 32 must be rigid to withstand the force of water moving past it. The longer, inflatable, upper mast section 34 is actually an elastomeric tube which inflates once the lower mast section 32 has deployed above the water surface.

When fully inflated, the visual appearance and radar footprint of the mast simulator 30 are similar to those of a naval service-type periscope or snorkel. The wake of the mast simulator 30 may differ somewhat from that of a real submarine mast, largely due to hydrodynamic effects caused by the submarine's large sail, but for training purposes the difference between the mast simulator and a real submarine mast is of minor significance.

The mast simulator 30 must be lightweight, to reduce its tendency to tip over when fully extended. As such, the rigid lower mast section 32 is hollow, to accommodate gas tubing and other components described below. However, when not extended, the mast simulator 30 retracts into the mast recess 18 on the faired shell 12 in order to reduce hydrodynamic drag.

Figure 4:
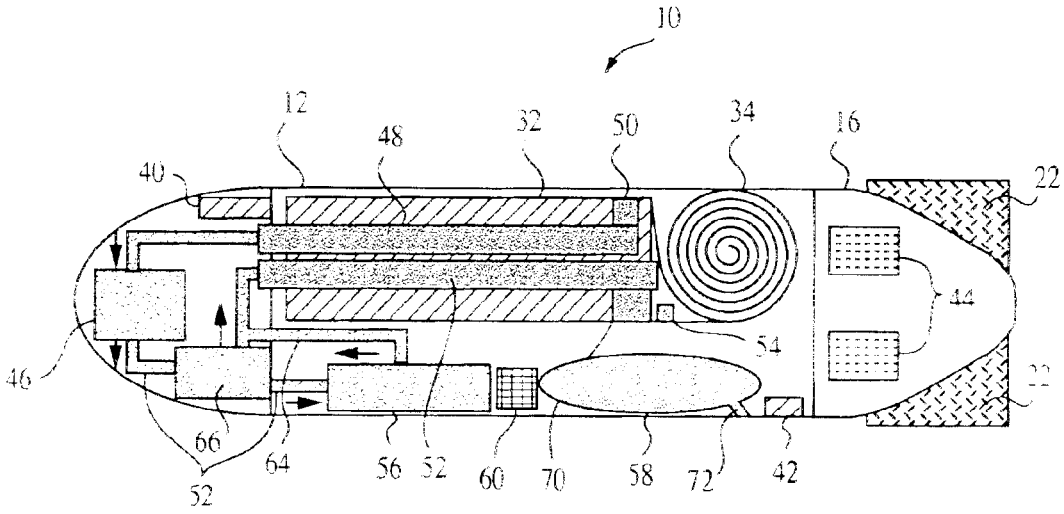
FIG. 4 is a schematic view of internal components of the mast simulator of the present invention.

Turning now to FIG. 4, there are shown additional internal components of the tow body 10 contributing to the operation of the mast simulator 30. In particular, a low-speed reversible electric motor 40 with controller is positioned within the tow body 10 to provide mechanical power to the mast simulator 30. A pressure sensor 42 is positioned at an outer surface of the faired shell 12 to measure the surrounding seawater pressure. Electromechanical actuators 44 are positioned at the tail 16 of the tow body 10 to drive the stabilizer fins 22. Mechanical links and gears (not shown) are connected to the lower mast section 32 with a sensor (not shown) determining the angular position of the mast simulator 30. Each of the mechanical links, gears and the sensor are known in the art such that any suitable arrangement may be applied to the device shown in order to effect operation of the mast simulator 30.

In further description of the mast simulator 30, an electric air pump 46 is positioned inside the faired shell 12 with inlet piping 48 connecting the lower mast section 32 to an inlet of the air pump. A normally closed (inlet) solenoid valve 50 is located at the atmospheric end of the inlet piping 48. Outlet piping 52 supplies pressurized air from an outlet port of the air pump 46. A pressure relief valve 54 is provided for the inflatable upper mast section 34.

An electrically-ignited heat source such as a combustor 56, supported by a bladder 58 containing hydrocarbon-based fuel, and an electric fuel pump 60 are also housed within the tow body 10. The piping section 52 connects the outlet port of the air pump 46 to an intake port of the combustor 56. A second piping section 64 connects an outlet port of the combustor 56 to a base of the inflatable upper mast section 34 via the rigid lower mast section 32. A three-way, two-position solenoid valve 66 directs an output flow from the air pump 46 to either the combustor 56 or to the inflatable upper mast section 34.

As shown in FIGS. 5 and 6, deployment of the mast simulator 30 begins with the tow vehicle 100 going to its minimum depth at a low speed. When the pressure sensor 42 of the tow body 10 indicates that the desired depth has been reached, electromechanical actuators 44 deflect the stabilizer fins 22 in a direction that lifts the nose 14 relative to the tail 16 of the tow body. This positive angle of attack for the tow body 10 forces the tow body to the surface, overcoming the downward drag forces exerted on the tow cable 21.

When the tow body 10 reaches the surface of the water, as indicated by the pressure sensor 42, the motor controller activates the motor 40. Through links and/or gears, the activated motor 40 extends the lower mast section 32 into its upright position shown in FIG. 5. The motor 40 stops when an angle sensor (not shown) indicates that the lower mast section 32 is fully raised a predetermined angle offset from the tow body 10.

Once the lower mast section 32 is raised, the upper mast section 34 is inflated by first energizing/opening the solenoid valve 50 to the atmosphere. The air pump 46 is activated, drawing in fresh air through the solenoid valve 50 and the inlet piping 48 within the lower mast section 32. The air is pumped into the outlet piping 52, back through the lower mast section 32, and into the upper mast section 34 which begins to inflate. Inflation of the upper mast section 34 proceeds with the upper mast section uncoiling upward and expanding outward until it is fully extended. Pumping stops when pressure inside the upper mast section 34 reaches a predetermined value, at which time the solenoid valve 50 closes. The operation of the pressure relief valve 54 precludes an overinflation of the upper mast section 34.

Although not shown, faster inflation of the upper mast section 34 may be accomplished by means of a compressed gas accumulator located within the tow body 10. The accumulator can be recharged by the air pump 46 while the mast simulator 30 is deployed above the water surface. Recharging the accumulator in this manner expedites the inflation process if multiple mast deployments are to be performed during a single mission.

When inflated, the mast simulator 30 presents the visual appearance of a submarine mast. Additionally, a radar-reflective coating 28 applied to the mast simulator 30 causes the mast simulator to exhibit the radar footprint of a submarine mast. In a third described, but nonexhaustive method of detection, the lower mast section 32 generates a realistic wake as it travels on the water surface. The size, shape, and other physical characteristics of the mast simulator 30 can be varied to mimic the visual appearance, radar footprint, and wake characteristics of most known submarine masts. It should be noted that the wake signature is also a function of the speed, orientation, and physical features of the tow body 10.

Simulation of infrared and chemical vapor emissions is accomplished as follows. At any time after the inlet solenoid valve 50 is opened and the air pump 46 is activated, the three-way solenoid valve 66 is energized. The solenoid valve 66 directs the flow of pumped air to the combustor 56, into which a hydrocarbon fuel from the fuel bladder 58 is pumped by the fuel pump 60 and electrically ignited in the combustor. Hot combustion gasses are directed by the tubing 64 into the upper mast section 34. Once the upper mast section 34 is fully inflated, the combustion gasses are automatically released to the atmosphere through the exhaust solenoid valve 70 and/or pressure relief valve 54. To prevent overinflation of the upper mast section 34 during activation of the air pump 46, the exhaust solenoid valve 70 may be continually cycled open and closed. The resulting infrared signature of released combustion gasses, both convective and radiative, mimics that of a snorkeling diesel submarine. By varying fuel type and operating characteristics of the combustor 56, the exact composition of the vapor emissions can be tailored to simulate those of diesel exhaust gasses.

The fuel bladder 58 is in communication with ambient and pressurized seawater by inlet port 72, thereby allowing the seawater to displace fuel as the fuel is consumed. Otherwise, the fuel would be displaced by gaseous vapors, greatly altering the buoyancy of the tow body 10.

A flexible antenna (not shown) integral to the upper mast section 34 can serve several functions. One such function is to receive global positioning system (GPS) signals, providing the tow vehicle 100 a precision navigation capability. The antenna might also serve as a radio frequency (RF) beacon to aid vehicle recovery efforts. In a general sense, the flexible antenna can be used to send or receive any type of data when deployed, via shielded wires within the tow cable.

Upon completion of a detection exercise using the mast simulator 30, the inlet solenoid valve 50 is closed and the air pump 46 is deactivated. In the same instant, the exhaust solenoid valve 70 opens, allowing the upper mast section 34 to deflate. As it deflates, the upper mast section 34 reverts to its original flattened and coiled condition. Once the upper mast section 34 is deflated, the exhaust solenoid valve 70 closes and the low-speed motor 40 lowers the mast simulator 30 into a retracted position within the mast recess 18. The tow vehicle 100 then dives and increases speed, pulling the tow body 10 behind it, to perform other duties or operations (see FIG. 6).

Alternatively, the tow vehicle 100 can release the tow cable 21 and/or tow body 10 prior to continuing its mission. In this case, the tow body 10 must be recovered separately and the upper mast section 34 should remain inflated to aid in its location and recovery. If the tow vehicle 100 and the tow body 10 have completed their mission and must be recovered together, the upper mast section 34 can remain inflated in order to facilitate a sighting of the tow body. Further, positive buoyancy provided by the inflated mast section 34 reduces the likelihood of the tow body 10 sinking in the event of seawater leaking into normally dry parts of the tow body.

Power for the motors 40, actuators 44, pumps 46 and 60, solenoid valves 50, 66, and 70, combustor 56, and sensors 42 is provided by the tow vehicle 100 and delivered through wires embedded within the tow cable 21. Communication between the tow vehicle 100 and the tow body 10 electronic subsystems is conducted in the same manner.

It will be appreciated that the present invention provides a tow body 10 with mast simulator 30 which simulates the geometric, radar, wake, infrared, and chemical vapor characteristics of a submarine's periscope, snorkel, or other type of mast. Surfacing is achieved through the use of active control surfaces 22, rather than buoyancy changes caused by bladder inflation. The tow body 10 becomes a mast simulator by raising a radar-reflective, wake-generating mast after the tow body surfaces. Infrared and chemical vapor emissions, which mimic a snorkeling diesel-electric submarine, are generated by means of the combustor 56 and a hydrocarbon-based fuel supply contained within the tow body 10.

In view of the above detailed description, it is anticipated that the invention herein will have far-reaching applications other than those of antisubmarine warfare training.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A submarine mast simulator comprising:

a tow body suitable for towing, said tow body including a nose and a tail;

a mast including a rigid lower mast section mechanically attached to said tow body and an upper mast section extendable from said lower mast section;

a motor with controller in mechanical connection with said mast for initiating the extension of said mast from said tow body;

a pressure sensor in connection with said tow body, wherein said controller initiates the extension of said mast in response to a depth indication by said pressure sensor; and a gas source fluidly connected to said upper mast section, said gas source supplying a gas to inflate said upper mast section thereby extending said upper mast section.

2. The submarine mast simulator in accordance with claim 1 wherein said tow body is indented to define a recessed area for housing said mast in a nonextended state.

3. The submarine mast simulator in accordance with claim 2, wherein said tow body further includes a plurality of stabilizer fins extending from said tail.

4. The submarine mast simulator in accordance with claim 3 wherein said tow body further includes actuators to control the direction of said stabilizer fins.

5. The submarine mast simulator in accordance with claim 4 wherein said mast further includes a radar-reflective coating on an outer surface thereof.

6. The submarine mast simulator in accordance with claim 5 further comprising harness attachments positioned equidistant from said nose to maximize a positive angle to a water surface during maneuvering in a towing operation.

7. The submarine mast simulator in accordance with claim 6 wherein said harness attachments are positioned between said nose and a longitudinal midpoint of said tow body.

8. The submarine mast simulator in accordance with claim 7 further comprising a flexible antenna positioned on an outer surface of said upper mast section.

9. The submarine mast simulator in accordance with claim 8 wherein said gas source of said tow body is an air pressurization system comprising a first solenoid valve controlling air flow to an air pump; and a second solenoid valve controlling air flow from said air pump for the inflation of said upper mast section.

10. The submarine mast simulator in accordance with claim 9 wherein said air pressurization system further includes a relief valve to maintain a predetermined pressure in said upper mast section.

11. The submarine mast simulator in accordance with claim 10 wherein said tow body further includes a hot gas emission system comprising a fuel bladder fluidly connected to a fuel pump supplying a combustor fluidly connected for supply by said air pressurization system, said combustor producing the hot gas emission exhaustable to the atmosphere out of said tow body.

* * * * *